US009905948B1

(12) United States Patent
Yu et al.

(10) Patent No.: US 9,905,948 B1
(45) Date of Patent: Feb. 27, 2018

(54) ELECTRICAL CONNECTOR WITH A BETTER FLATNESS OF SOLDERING TAILS

(71) Applicant: ALLTOP ELECTRONICS (SUZHOU) LTD., Tai Cang, JiangSu (CN)

(72) Inventors: Wang-I Yu, New Taipei (TW); Yung-Chih Hung, New Taipei (TW); Li-Li Liang, Tai Cang (CN); Yong-Gang Zhang, Tai Cang (CN); Feng Zheng, Tai Cang (CN)

(73) Assignee: ALLTOP ELECTRONICS (SUZHOU) LTD., Tai cang, JiangSu (CN)

( * ) Notice: Subject to any disclaimer, the term of this patent is extended or adjusted under 35 U.S.C. 154(b) by 0 days.

(21) Appl. No.: 15/689,876

(22) Filed: Aug. 29, 2017

Related U.S. Application Data

(63) Continuation-in-part of application No. 15/358,208, filed on Nov. 22, 2016, now Pat. No. 9,774,115.

(30) Foreign Application Priority Data

Aug. 31, 2016 (CN) ..... 2016 1 0794332
Jul. 31, 2017 (CN) ..... 2017 1 0641537

(51) Int. Cl.

| | |
|---|---|
| ***H01R 12/00*** | (2006.01) |
| ***H01R 12/72*** | (2011.01) |
| ***H01R 13/41*** | (2006.01) |
| ***H01R 12/70*** | (2011.01) |
| ***H01R 13/502*** | (2006.01) |

(52) U.S. Cl.
CPC ..... *H01R 12/721* (2013.01); *H01R 12/7082* (2013.01); *H01R 13/41* (2013.01); *H01R 13/502* (2013.01)

(58) Field of Classification Search
CPC .. H01R 12/721; H01R 12/707; H01R 13/502; H01R 13/42; H01R 13/41; H01R 12/7082
See application file for complete search history.

(56) References Cited

U.S. PATENT DOCUMENTS

| | | | | |
|---|---|---|---|---|
| 7,473,133 | B1 | 1/2009 | Zhang | |
| 8,007,327 | B2 | 8/2011 | Yang et al. | |
| 8,172,620 | B2 * | 5/2012 | Su | H01R 13/42 439/607.01 |
| 9,774,115 | B1 * | 9/2017 | Liang | H01R 12/707 |
| 2011/0130046 | A1 | 6/2011 | Su et al. | |
| 2012/0202384 | A1 | 8/2012 | Liaw et al. | |
| 2014/0308848 | A1 | 10/2014 | Shi et al. | |

* cited by examiner

*Primary Examiner* — Jean F Duverne
(74) *Attorney, Agent, or Firm* — Sughrue Mion, PLLC

(57) ABSTRACT

An electrical connector includes an insulative housing and a plurality of contacts. The insulative housing has a main portion defining a top wall, a bottom wall and a mating cavity, the bottom wall has a first segment, a second segment spaced apart from the first segment and a protrusion extending away from the mating cavity, the protrusion is located between the first segment and the second segment. Each contact has a retention portion, a contacting arm and a soldering tail, the contacts comprises a group of first contacts, a group of second contacts, a group of third contacts and a group of fourth contacts. A distance between the retention portion and the soldering tail of each fourth contact along a height direction is larger than a distance between the retention portion and the soldering tail of each second contact.

16 Claims, 8 Drawing Sheets

ELECTRICAL CONNECTOR WITH A BETTER FLATNESS OF SOLDERING TAILS

CROSS REFERENCE TO RELATED APPLICATIONS

The present application is a continuation-in-part application of U.S. patent application Ser. No. 15/358,208 filed on Nov. 22, 2016, and claims the priority from Chinese Patent Application No. 201710641537.X, filed on Jul. 31, 2017, and Chinese Patent Application No. 201610794332.0, filed on Aug. 31, 2016, the contents of all of which are incorporated herein by reference in their entirety.

BACKGROUND OF THE INVENTION

1. Field of the Invention

The present invention relates to an electrical connector, and more particularly to an electrical connector having a better flatness.

2. Description of Related Art

A great variety of connectors are used for data transmission, data storage, or image display in electronic products, such as from the early general application of ATA (Advanced Technology Attachment) to SCSI (Small Computer System Interface), SATA (Serial Advanced Technology Attachment) or the more recent SAS (Serial Attached SCSI). For many emerging applications that require high speed data transmission, serial technology can solve the performance bottleneck problem of traditional parallel technology, Serial Attached SCSI (SAS) is developed from parallel SCSI based on serial technology, and except the advantages of a higher signal transmission rate, the SAS interface also can be compatible with the SATA driver and has a smaller profile than the SCSI transmission interface.

When the evolution of SATA (Serial Advanced Technology Attachment) transmission interface encounters a bottleneck in the transmission rate, PCI Express (PCIe) transfer protocols is used as a breakthrough, thus SATA Express connector being applicable to SATA transfer protocols or PCI Express (PCIe) transfer protocols has come into being. When the evolution of SAS transmission interface encounters a bottleneck in the transmission rate, PCI Express (PCIe) transfer protocols is also used as a breakthrough, thus U.2 (SFF-8639) connector being applicable to SAS transfer protocols or PCI Express (PCIe) transfer protocols has come into being. As the SAS connector is compatible with SATA connector, so a SFF-8639 connector can be compatible with SATA, SAS, SATA Express or PCIe connector. SFF-8639 connector is mainly used for high-speed serial signal transmission and power supply, and usually with an enhanced design, to achieve a higher reliability in the compact storage applications. However the SFF-8639 connector has a smaller profile with a larger number of contacts, the flatness of solder tails of contacts for surface mounting to the printed circuit board is difficult to be guaranteed.

Hence, it is desired to provide an electrical connector to overcome the problems mentioned above.

BRIEF SUMMARY OF THE INVENTION

Accordingly, an object of the present invention is to provide an electrical connector having a better flatness of soldering tails.

The present invention is directed to an electrical connector comprising an insulative housing and a plurality of contacts retained in the insulative housing. The insulative housing has a main portion and a mating portion extending forwardly from the main portion. The mating portion defines a top wall, a bottom wall and a mating cavity formed between the top wall and the bottom wall, the bottom wall has a first segment, a second segment spaced apart from the first segment and a protrusion extending away from the mating cavity, the protrusion is located between the first segment and the second segment. Each contact has a retention portion retaining in the main portion, a contacting arm and a soldering tail, and the plurality of contacts comprises a group of first contacts, a group of second contacts, a group of third contacts and a group of fourth contacts, the contacting arms of the first contacts are arranged side by side in the top wall exposed downwards in the mating cavity, the contacting arms of the second contacts and the third contacts are juxtaposed in the first segment and the second segment of the bottom wall respectively, the contacting arms of the fourth contacts are abreast in the protrusion of the bottom wall. A distance between the retention portion and the soldering tail of each fourth contact along a height direction is larger than a distance between the retention portion and the soldering tail of each second contact along the height direction.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
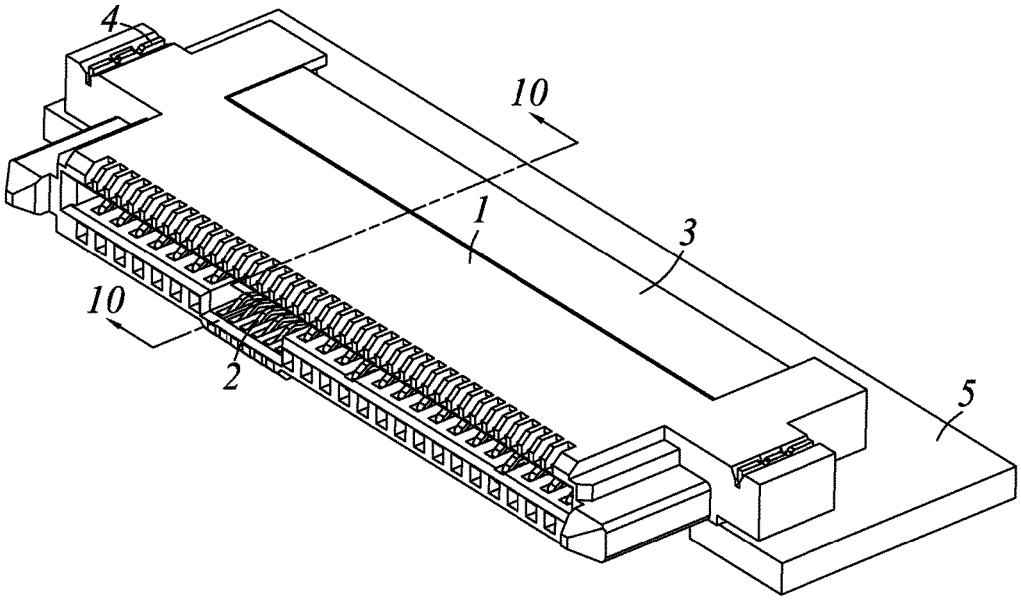
FIG. 1 is a perspective view of an electrical connector mounted on a printed circuit board in accordance with the present invention.
Figure 2:
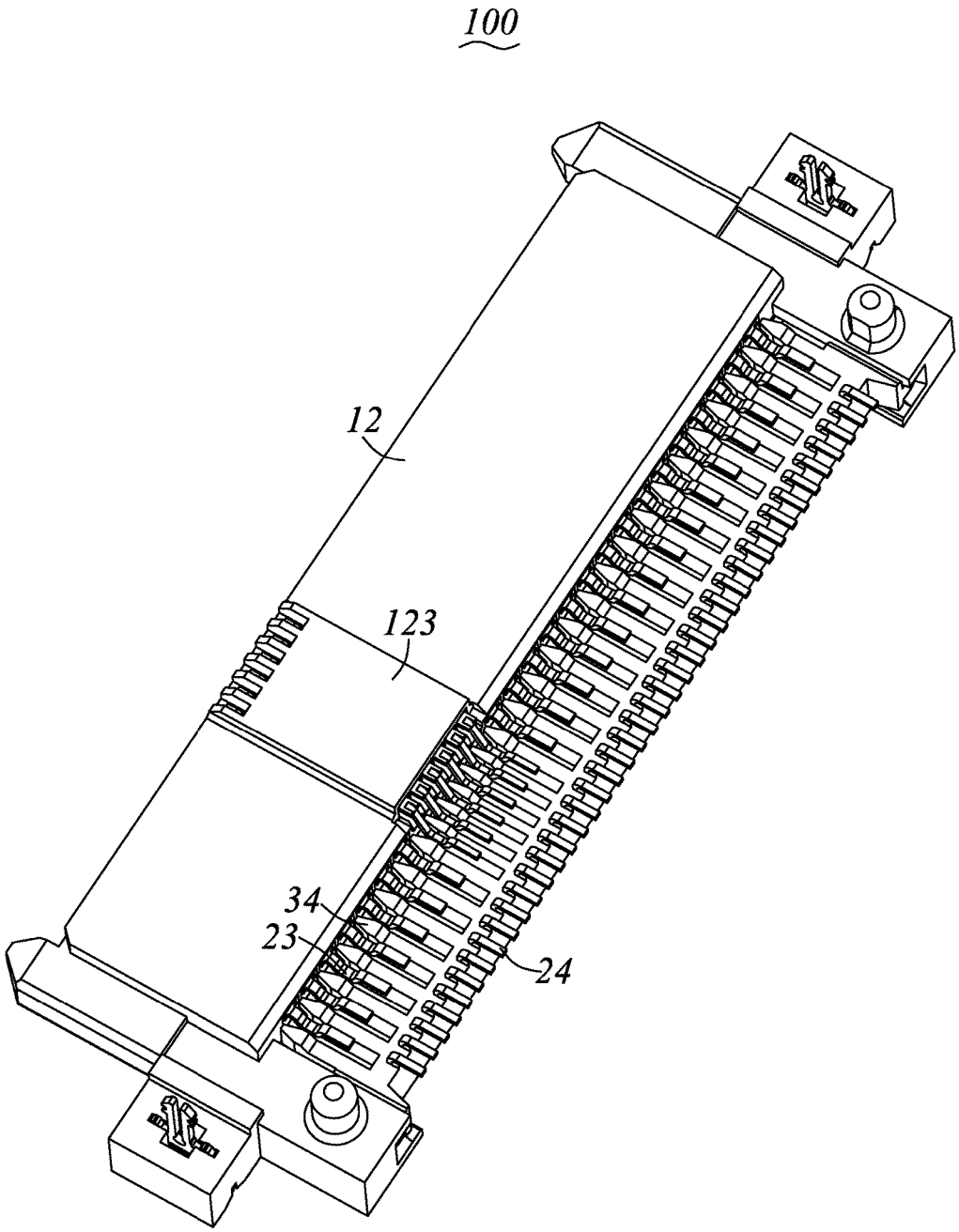
FIG. 2 is another perspective view of the electrical connector shown in FIG. 1.
Figure 3:
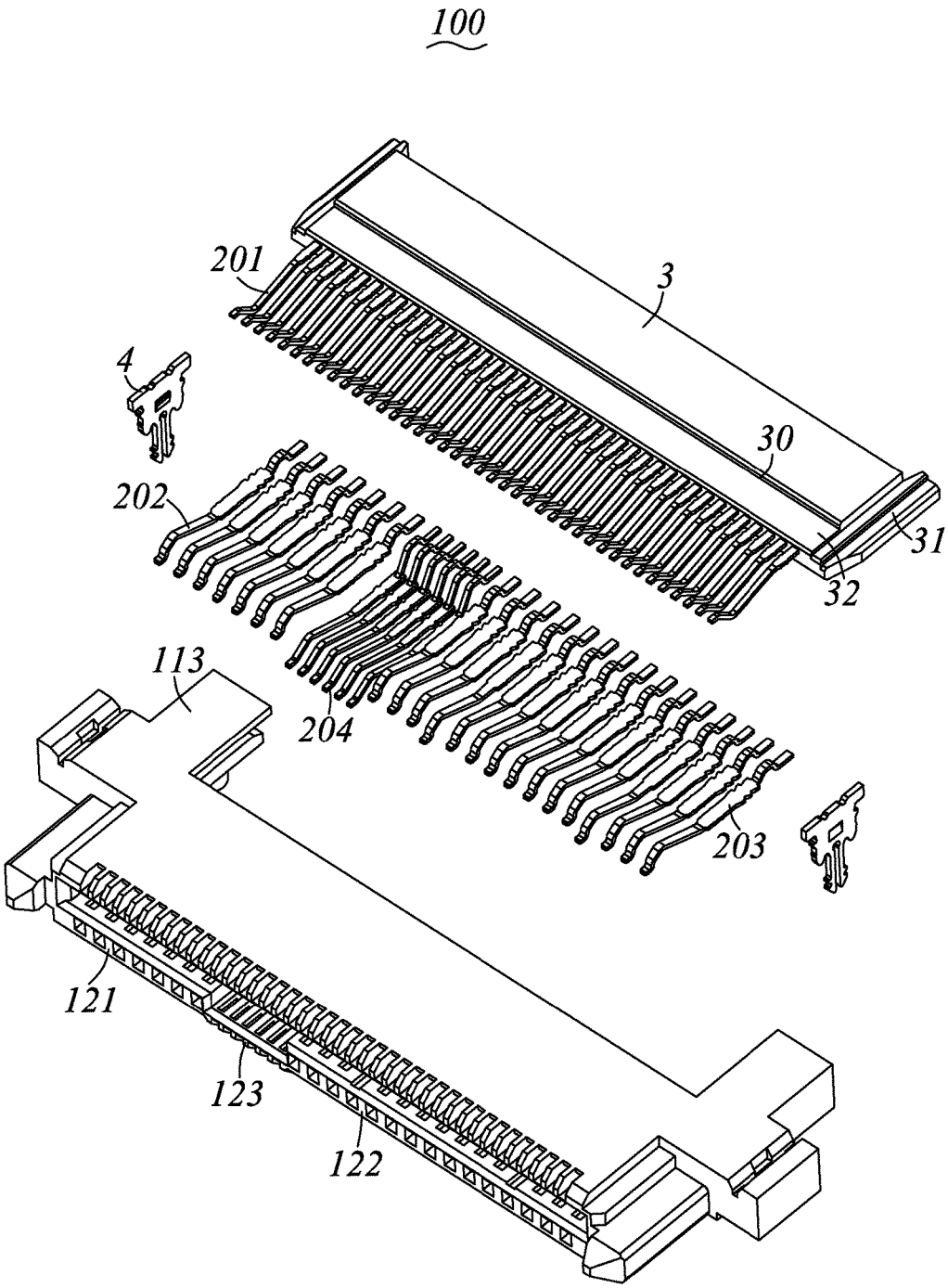
FIG. 3 is an exploded perspective view of the electrical connector shown in FIG. 1.
Figure 4:
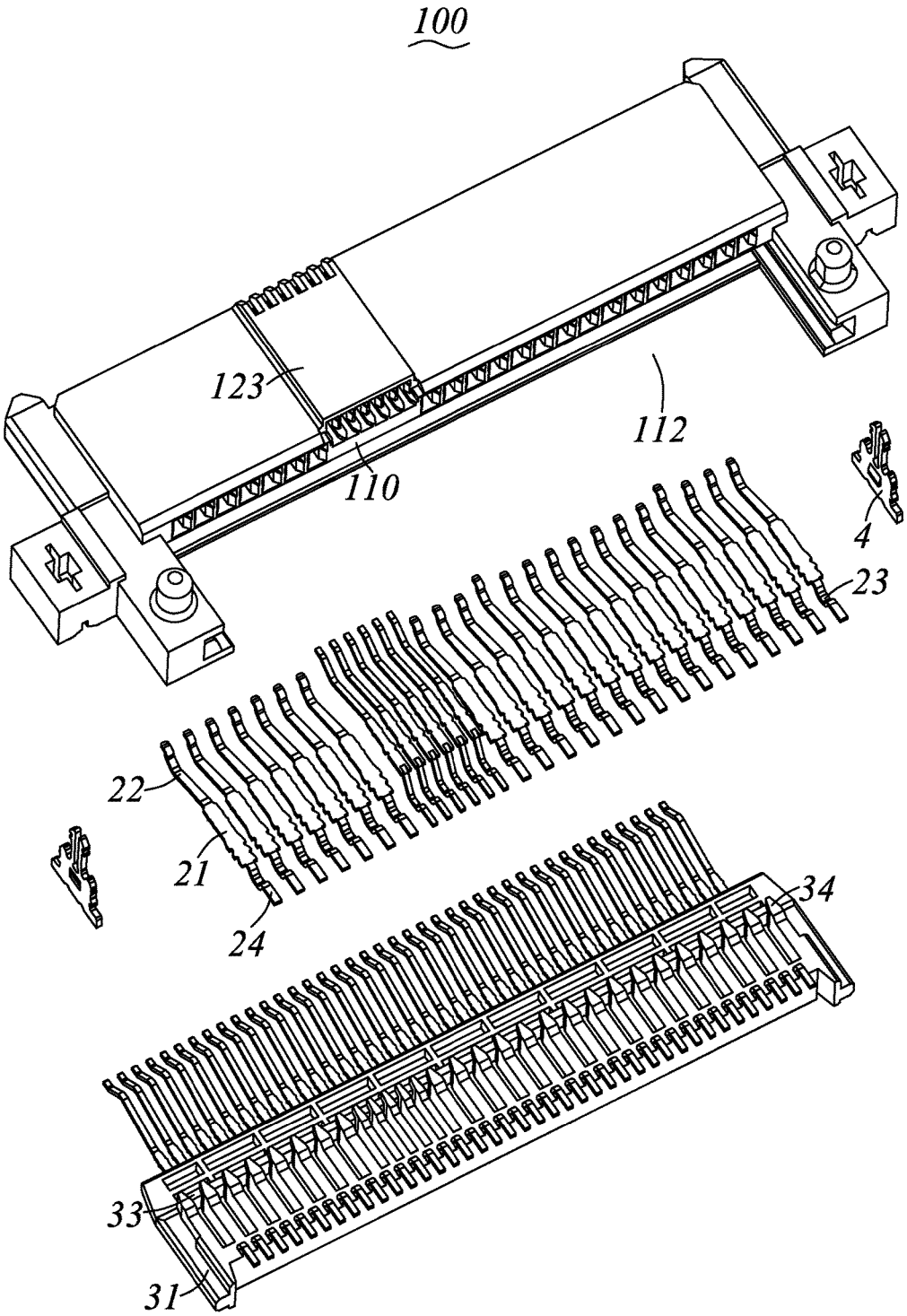
FIG. 4 is similar to FIG. 3, but viewed from a different angle.
Figure 5:
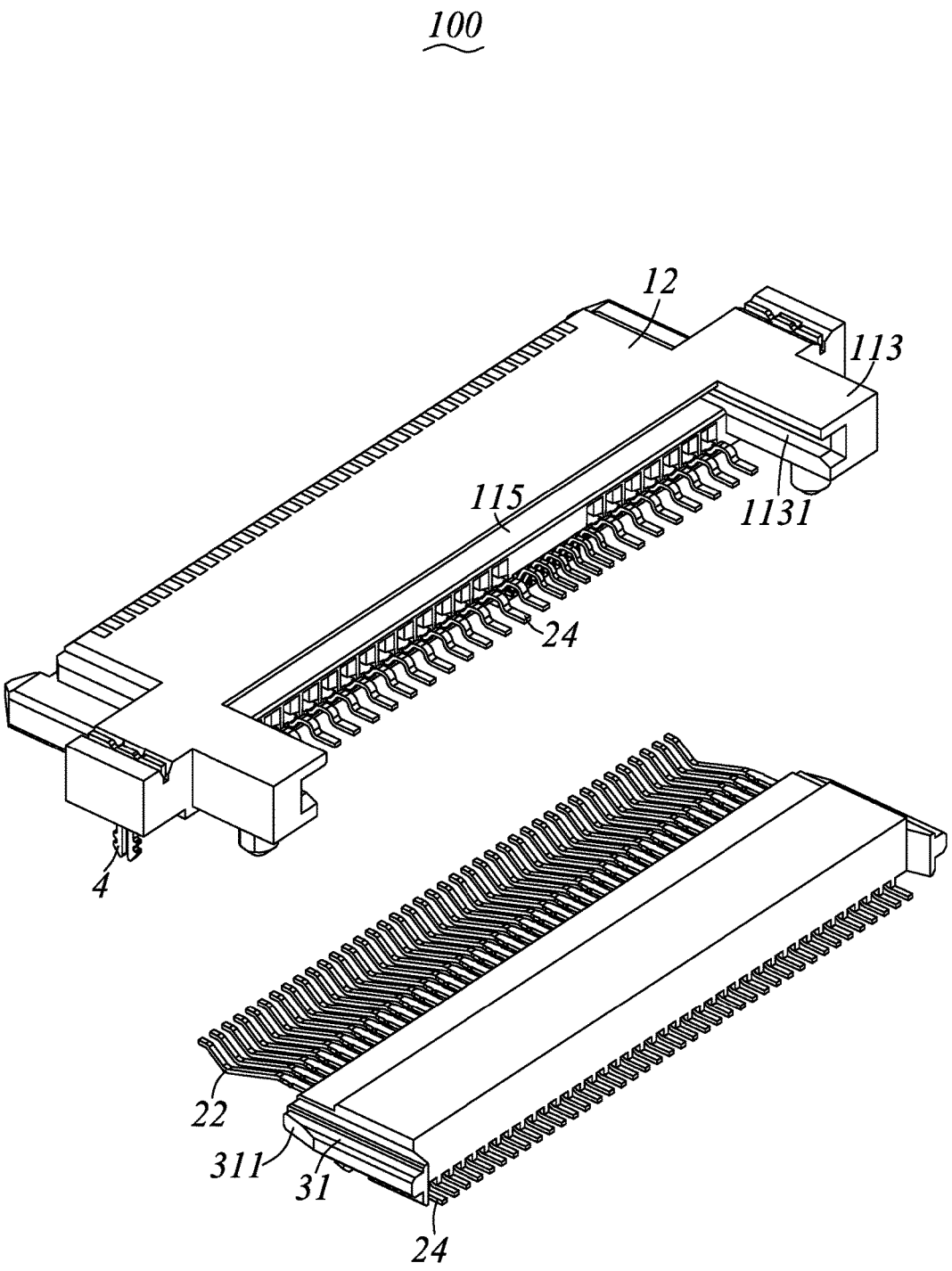
FIG. 5 is a partial assembled view of the electrical connector shown in FIG. 3.

Reference will be made to the drawing figures to describe the present invention in detail, wherein depicted elements are not necessarily shown to scale and wherein like of similar elements are designated by same or similar reference numeral through the several views and same or similar terminology.

FIGS. 1-10 illustrate an electrical connector 100, for mounting on a printed circuit board 5, and comprises an elongated insulative housing 1 and a plurality of contacts 2 retaining in the insulative housing 1, and the electrical connector 100 is positioned and locked on the printed circuit board 5 via a pair of fasteners 4 being inserted on both sides of the insulative housing 1.

Figure 10:
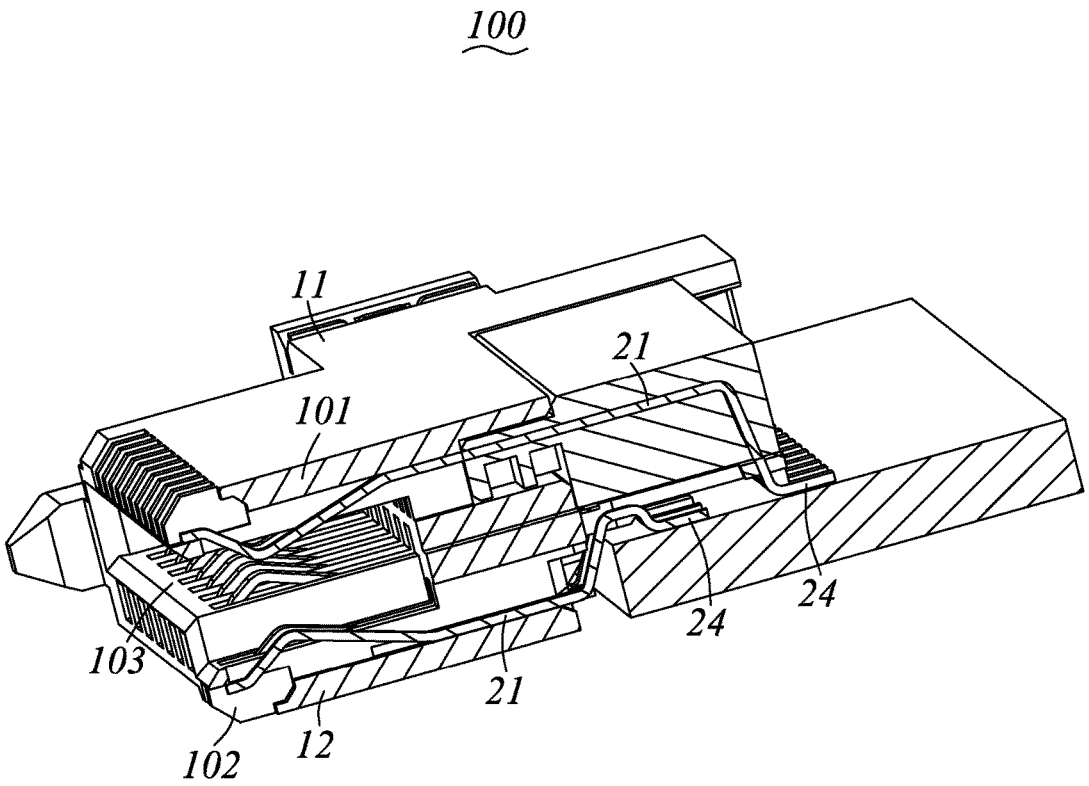
FIG. 10 is a stepped cross-section view taken along line 10-10 of FIG. 1.

Referring to FIGS. 1-5 and conjunction with FIG. 10, the insulative housing 1 comprises a main portion 11 and a mating portion 12 extending forwards from the main portion 11, the mating portion 12 defines a top wall 101, a bottom wall 102 and a mating cavity 103 formed between the top wall 101 and the bottom wall 102. The bottom wall 102 has a first segment 121, a second segment 122 spaced apart from the first segment 121 and a protrusion 123 extending away from the mating cavity 103, the protrusion 123 is located between the first segment 121 and the second segment 122.

The main portion 11 defines a mounting face 110, a mounting space 112 behind the mounting face 110 and a pair of mounting walls 113 on both sides of the mounting space 112, the mounting space 112 is opening backwards. The pair of mounting walls 113 are generally parallel and opposite to each other, and each mounting wall 113 has a positioning slot 1131 extending along a front-and-back direction, the two positioning slots 1131 of the pair of mounting walls 113 are opposite to each other and communicated with the mounting space 112. The mounting space 112 is formed by the pair of mounting walls 113 connected with the mounting face 110. A channel 115 is recessed forwardly from the mounting face 110 of the main portion 11, and the channel 115 is elongated and extending from one mounting wall 113 to the opposite mounting wall 113 along a transverse direction. The two positioning slots 1131 are communicated with the channel 115.

The plurality of contacts 2 are retained in the insulative housing 1, and each contact 2 comprises a retention portion 21 retained in the main portion 11, a contacting arm 22 extending forwardly from a front end of the retention portion 21 to the mating portion 12 and a rear soldering tail 24 for connecting with the printed circuit board 5. Each contact 2 also has an extension portion 23 located and connected between the retention portion 21 and the soldering tail 24.

The plurality of contacts 2 comprises a group of first contacts 201, a group of second contacts 202, a group of third contacts 203 and a group of fourth contacts 204. The extension portion 23 of each first contact 201 is extending downwards from the corresponding retention portion 21, and the extension portions 23 of the contacts 2 (at least one group of the second contacts 202, the third contacts 203 and the fourth contacts 204) located in the bottom wall 102 are arching up to protrude into the relative receiving slot 33 of an insulator 3. In the preferred embodiment, the extension portions 23 of the contacts 2 located in the bottom wall 102 are flush with the top surfaces thereof.

The contacting arms 22 of the first contacts 201 are arranged side by side in the top wall 101, and exposed downwards in the mating cavity 103, the contacting arms 22 of the second contacts 202 and the third contacts 203 are juxtaposed in the first segment 121 and the second segment 122 of the bottom wall 102 respectively, the contacting arms 22 of the fourth contacts 204 are abreast in the protrusion 123 of the bottom wall 102. The contacting arms 22 of the second contacts 202, the third contacts 203 and the fourth contacts 204 are exposed upwards into the mating cavity 103, and opposite to the contacting arms 22 of the first contacts 201 along a height direction of the insulative housing 1. The contacting points of the contacting arms 22 of the second contacts 202 and the third contacts 203 are located on a same height, and the contacting points of the first contacts 201 are located above that of the second contacts 202, the contacting points of the fourth contacts 204 are located below that of the second contacts 202.

The soldering tails 24 of the second contacts 202, the third contacts 203 and the fourth contacts 204 are arranged in a line along the transverse direction, and flush with each other, and located in front of the soldering tails 24 of the first contacts 201. In the preferred embodiment, the extension portion 23 and the soldering tail 24 of each fourth contact 204 are formed by tearing from a rear end of the corresponding retention portion 21, and the retention portion 21 has a width larger than the corresponding extension portion 23 or the soldering tail 24 along the transverse direction.

Figure 6:
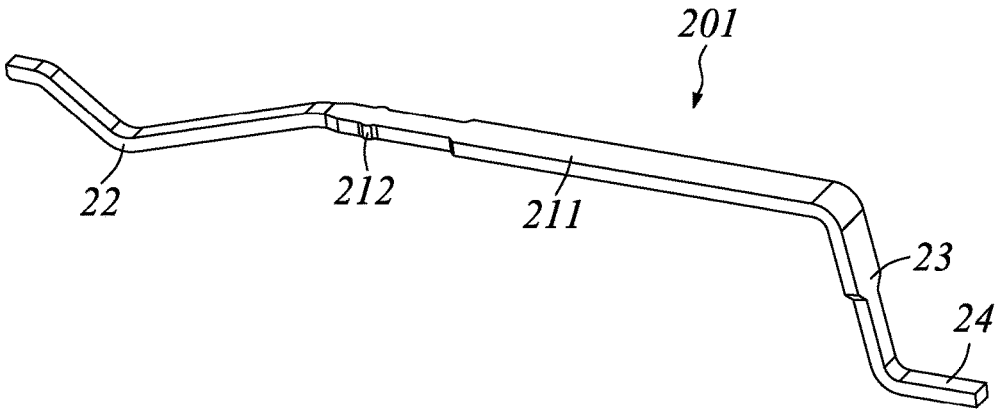
FIG. 6 is a perspective view of a first contact of the electrical connector shown in FIG. 3.
Figure 7:
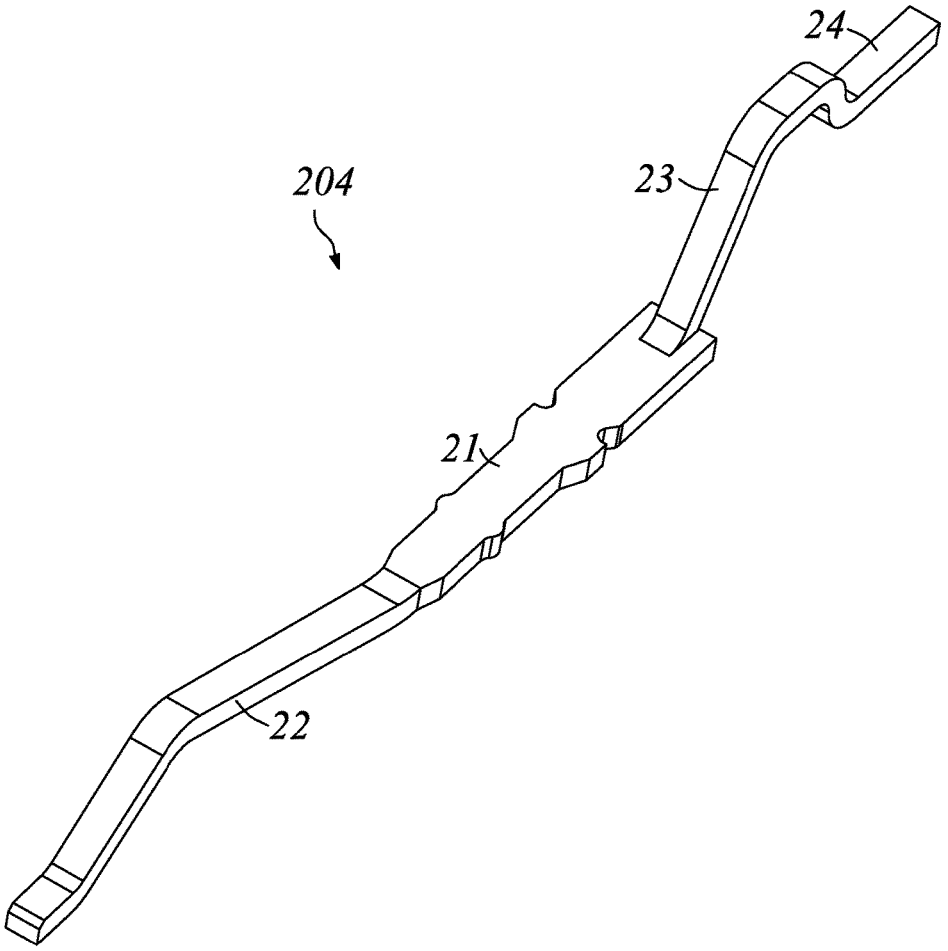
FIG. 7 is a perspective view of a fourth contact of the electrical connector shown in FIG. 3.

Please referring to FIG. 6, the retention portion 21 of each first contact 201 has a widened base portion 211, and the width of the base portion 211 is larger than the width of the contacting arm 22 or the soldering tail 24 along the transverse direction. Simultaneously, the retention portion 21 of each first contact 201 has a pair of tubers 212 on both sides thereof, and the tubers 212 are located in front of the base portion 211. When the first contacts 201 assembled into the insulative housing 1, the tubers 212 are located in front of the mounting face 110 and interferentially retained with the insulative housing 1.

Figure 8:
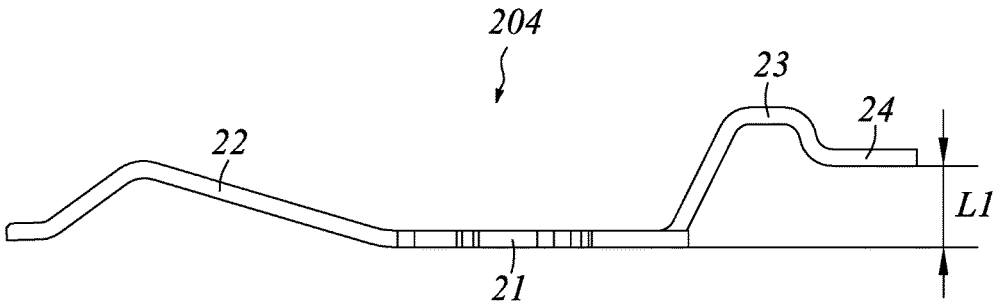
FIG. 8 is a side elevational view of the fourth contact shown in FIG. 7.
Figure 9:
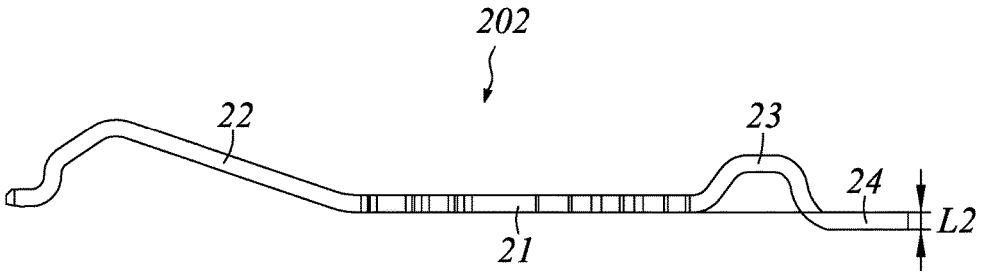
FIG. 9 is a perspective view of a second contact of the electrical connector shown in FIG. 3.

Please referring to FIGS. 8-9, the soldering tail 24 of each fourth contact 204 is located on an upper side of the retention portion 21 along the height direction. Specifically, a distance (L1) between the retention portion 21 and the soldering tail 24 of each fourth contact 204 along the height direction is larger than a distance (L2) between the retention portion 21 and the soldering tail 24 of each second contact 202 along the height direction, and the distance (L1) is also larger than a distance (L3) between the retention portion 21 and the soldering tail 24 of each third contact 203 along the height direction.

The distance (L2) between the retention portion 21 and the soldering tail 24 of each second contact 202 along the height direction is not equal to zero, that is to say, there is a height difference between the retention portion 21 and the soldering tail 24 of each second contact 202 necessarily, and the distance (L2) is at least equivalent to a height of the retention portion 21 of the second contact 202. Similar to the second contact 202, there is a height difference between the retention portion 21 and the soldering tail 24 of each third contact 203 necessarily, that is, the distance (L3) is not equal to zero.

Referring to FIGS. 2-5, and conjunction with FIG. 10, the insulator 3 of the electrical connector 100 is molded on the retention portions 21 of the group of first contacts 201. The insulator 3 defines a positioning portion engaging with the main portion 11 of the insulative housing 1. In present embodiment, a pair of positioning tabs 31 are extruding outside from both sides of the insulator 3 and served as the positioning portion, and the positioning tabs 31 are sliding into and cooperated with the corresponding positioning slots 1131 of the main portion 11 along a back-to-front direction. Each positioning tab 31 extends along the front-and-back direction and defines a sharpened leading portion 311 on a front end thereof, thus to achieve a facile insertion of the insulator 3 into the insulative housing 1. The insulator 3 also has an insertion portion 32 on a front side thereof for assembling into the channel 115 of the insulative housing 1, and a stopping surface 30 behind the insertion portion 32 is abutting against the mounting face 110 of the insulative housing 1.

The insulator 3 defines a plurality of the receiving slots 33 recessed upwards from a bottom surface thereof, and the receiving slots 33 are arranged in a row along the transverse direction. Each receiving slot 33 is formed by two neighboring guide bumps 34 spaced apart from each other, and the extension portions 23 of the contacts 2 located in the bottom wall 102 are matched with the receiving slots 33 in one-to-one correspondence. Each extension portion 23 is sandwiched and limited by two neighboring guide bumps 34, to ensure the position accuracy and coplanarity of the contacts 2 located in the bottom wall 102. When the insulator 3 assembled to the insulative housing 1, the extension portions 23 can be inserted into the corresponding receiving slot 33 conveniently by a sharpened front end of the corresponding guide bump 34.

The electrical connector 100 in accordance with the present invention is an offset type connector, the plurality of first contacts 201 are integrally insert-molded in the insulator 3, to ensure the flatness of soldering tails 24 of the first contacts 201 effectively. The soldering tails 24 of the contacts 2 are located on a same level to be flattened and welded on the printed circuit board 5, and the contacts 2 are simply inserted and assembled into the insulative housing 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mounting on a printed circuit board, comprising:

an insulative housing having a main portion and a mating portion extending forwardly from the main portion, the mating portion defining a top wall, a bottom wall and a mating cavity formed between the top wall and the bottom wall, the bottom wall having a first segment, a second segment spaced apart from the first segment and a protrusion extending away from the mating cavity, the protrusion located between the first segment and the second segment; and a plurality of contacts retained in the insulative housing, and each contact having a retention portion retaining in the main portion, a contacting arm extending forwardly from a front end of the retention portion to the mating portion and a rear soldering tail for connecting with the printed circuit board, and the plurality of contacts comprising a group of first contacts, a group of second contacts, a group of third contacts and a group of fourth contacts, the contacting arms of the first contacts arranged side by side in the top wall and exposed downwards in the mating cavity, the contacting arms of the second contacts and the third contacts juxtaposed in the first segment and the second segment of the bottom wall respectively, the contacting arms of the fourth contacts abreast in the protrusion of the bottom wall; wherein a distance between the retention portion and the soldering tail of each fourth contact along a height direction is larger than a distance between the retention portion and the soldering tail of each second contact along the height direction.

2. The electrical connector as claimed in claim 1, wherein the distance between the retention portion and the soldering tail of each fourth contact along the height direction is also larger than a distance between the retention portion and the soldering tail of each third contact along the height direction.

3. The electrical connector as claimed in claim 2, wherein there is a height difference between the retention portion and the soldering tail of each second contact necessarily, and there is a height difference between the retention portion and the soldering tail of each third contact necessarily.

4. The electrical connector as claimed in claim 3, wherein the distance between the retention portion and the soldering tail of each second contact along the height direction is at least equivalent to a height of the retention portion of the second contact.

5. The electrical connector as claimed in claim 1, further comprising an insulator integrally molded on the retention portions of the group of first contacts, wherein the insulator defines a positioning portion engaging with the main portion of the insulative housing.

6. The electrical connector as claimed in claim 5, wherein each contact also has an extension portion located and connected between the retention portion and the soldering tail, the extension portion of each first contact is extending downwards from the corresponding retention portion.

7. The electrical connector as claimed in claim 6, wherein the extension portions of the contacts located in the bottom wall are arching up to protrude into relative receiving slots of the insulator.

8. The electrical connector as claimed in claim 7, wherein the extension portions of the contacts located in the bottom wall are flush with the top surfaces thereof.

9. The electrical connector as claimed in claim 7, wherein the insulator defines a plurality of the receiving slots recessed upwards from a bottom surface thereof, and the receiving slots are arranged in a row along the transverse direction, each receiving slot is formed by two neighboring guide bumps spaced apart from each other.

10. The electrical connector as claimed in claim 9, wherein the extension portions of the contacts located in the bottom wall are matched with the receiving slots in one-to-one correspondence, and each extension portion is sandwiched and limited by two neighboring guide bumps.

11. The electrical connector as claimed in claim 5, wherein the main portion defines a rear mounting space opening backwards and a pair of mounting walls on both sides of the mounting space, a pair of positioning tabs are extruding outside from both sides of the insulator and served as the positioning portion, and the positioning tabs are sliding into and cooperated with the corresponding positioning slots of the main portion along a back-to-front direction.

12. The electrical connector as claimed in claim 11, wherein each positioning tab extends along the front-and-back direction and defines a sharpened leading portion on a front end thereof.

13. The electrical connector as claimed in claim 11, wherein the insulator also has an insertion portion on a front side thereof for assembling into a channel of the insulative housing, and a stopping surface behind the insertion portion is abutting against a mounting face of the insulative housing.

14. The electrical connector as claimed in claim 1, wherein the retention portion of each first contact has a widened base portion, and the width of the base portion is larger than the width of the contacting arm or the soldering tail along the transverse direction.

15. The electrical connector as claimed in claim 14, wherein the retention portion of each first contact has a pair of tubers on both sides thereof, and the tubers are located in front of the base portion, the tubers are located in front of a mounting face and interferentially retained with the insulative housing when the first contacts assembled into the insulative housing.

16. The electrical connector as claimed in claim 1, wherein the contacting arms of the second contacts, the third contacts and the fourth contacts are exposed upwards into the mating cavity, and opposite to the contacting arms of the first contacts along the height direction of the insulative housing.

* * * * *